United States Patent [19]

den Otter

[11] Patent Number: 4,483,257

[45] Date of Patent: Nov. 20, 1984

[54] METHOD AND DEVICE FOR PREPARING A FLUID HYDROCARBON PRODUCT FROM COAL

[75] Inventor: Johan L. den Otter, Leidschendam, Netherlands

[73] Assignee: Nederlandse Centrale Organisatie voor Toegepast-Natuurwetenschappelijk Onderzoek, The Hague, Netherlands

[21] Appl. No.: 491,366

[22] Filed: May 4, 1983

[30] Foreign Application Priority Data

May 4, 1982 [NL] Netherlands ..... 8201824

[51] Int. Cl.[3] ..... F23K 1/00

[52] U.S. Cl. ..... 110/218; 110/341; 110/347; 202/118; 264/23; 425/378 R

[58] Field of Search ..... 110/218, 229, 232, 347, 110/341; 202/118; 264/23; 425/378 R

[56] References Cited

U.S. PATENT DOCUMENTS 3,976,548 8/1976 Kevorkian et al. .
4,206,713 6/1980 Ryason .
4,401,039 8/1983 Goudy, Jr. ..... 110/218 X

FOREIGN PATENT DOCUMENTS 740664 1/1933 France .

OTHER PUBLICATIONS

Ingo Romey: "Stand der Kohlehydrierung in Europa", in Erdoel und Kohle-Erdgas-Petrochemie, vol. 33, No. 7 (Jul. 1980), p. 314.

*Primary Examiner*—Edward G. Favors
*Attorney, Agent, or Firm*—Brumbaugh, Graves, Donohue & Raymond

[57] ABSTRACT

Coal is continuously fed into an extruder and reacts therein at elevated pressure and temperature and possibly in the presence of a catalyst with hydrogen and/or hydrogen containing compounds added to the contents of the extruder on at least one spot situated at a distance of at least three times the inner diameter of the extruder in front of the end of the screw. From the reaction product leaving the extruder hydrocarbons which are fluid under normal conditions are separated.

Part of these hydrocarbons which are liquid under normal conditions may be recycled to the extruder.

11 Claims, 2 Drawing Figures

METHOD AND DEVICE FOR PREPARING A FLUID HYDROCARBON PRODUCT FROM COAL

Figure 1:
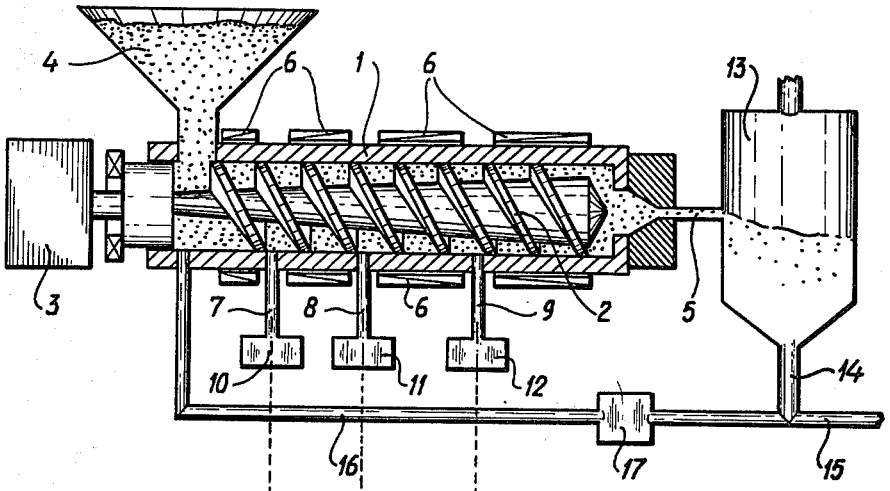

The invention relates to a method for preparing a hydrocarbon product which is fluid under normal conditions, by continuously feeding coal into an extruder where it reacts, possibly in the presence of a catalyst, under elevated pressure and temperature with hydrogen and/or hydrogen containing compounds, and by separating from the reaction product leaving the extruder at least the greater part of the hydrocarbons which are fluid under normal conditions.

Further the invention relates to a device for carrying out this method.

In this specification and the attached claims the term "fluid" means "liquid and/or gaseous".

It is known that fluid hydrocarbon products can be prepared by reacting coal under elevated pressure and temperature and possibly in the presence of a catalyst, with hydrogen and/or hydrogen containing compounds. See Ingo Romey "Stand der Kohlehydrierung in Europa" and E. Wolowski O. Funk "Stand der Kohlehydrierung ausserhalb von Europa" in Erdoel and Kohle-Erdgas-Petrochemie, Vol. 33, Nr. 7 (July 1980), page 314. As a rule such a reaction is carried out batchwise, among others because it is a rather difficult technical problem to feed coal and more in general a solid continuously into a reactor in which there is a high pressure, i.e. a pressure of some hundreds bar.

In U.S. Pat. No. 3,976,548 it is proposed to feed continuously coal into a high pressure reactor by means of an extruder. In this process use is made of the phenomenon that coal behaves itself as a plastic mass under elevated pressure and temperature, the temperature and the pressure at which this occurs being highly dependent on the nature of the coal.

In U.S. Pat. No. 4,206,713 an extruder is described in which coal is treated in such a way that it behaves itself as a plastic mass. At the end of the extruder, i.e. at the last winding of the screw, water and a catalyst are added to the plastified coal. These react with the coal and form among others a liquid hydrocarbon product, carbon monoxide and another gaseous product that contains the greater part of the sulphur that was present in the coal.

Since the reaction is not yet finished when the reaction mixture leaves the extruder a tube provided with heating means in which the reaction can be completed is connected behind the outlet of the extruder. After the reaction mixture has left the extruder the reaction taking place in the tube can only be affected by controlling the temperature profile along the length of the tube. It is not possible to affect the reaction in the tube by adding substances to the reaction mixture at one or more spots in the tube and/or to locally influence the pressure.

From the latter U.S. patent it does not appear that the method mentioned above has indeed been carried out with an extruder at a pressure of e.g. 300 bar. This is not amazing since when coal is compressed at a pressure of 300 bar or more in an extruder of a conventional type forces are exerted upon the screw which it cannot stand.

The invention is based on the insight that it is advantageous when a reaction between coal and hydrogen and/or hydrogen containing compounds takes place over the whole or at least a substantial part of the length of the extruder, the reaction being capable of being affected at some spots not only by the temperature at those spots, but also by the injection of catalyst and/or hydrogen and/or hydrogen containing compounds. More in particular the friction of the reaction mixture can locally be decreased by injecting substances which act as lubricants, e.g. hydrocarbon oils, thus enabling the application of very high pressures without overloading the screw.

The invention therefore relates to a method of the type mentioned in the beginning, which method is characterized by the fact that on at least one spot located in front of the end of the screw at a distance of at least three times the inner diameter of the extruder catalyst and/or hydrogen and/or hydrogen containing compounds are added to the contents of the extruder.

However, it is to be preferred that catalyst and/or hydrogen and/or hydrogen containing compounds are added to the contents of the extruder on at least two spots spaced apart in the direction of the length of the extruder.

According to a preferred embodiment of the method according to the invention the reaction takes place in at least two zones spaced apart in the direction of the length of the extruder, the pressure and the temperature in each zone being different from those in the adjacent zone(s) and in which—seen in the travel direction of the reaction mixture—at least at the beginning of each zone catalyst and/or hydrogen and/or hydrogen containing compounds are added to the contents of the extruder.

Part of the hydrocarbons obtained according to the invention, which hydrocarbons are liquid under normal conditions, can be recycled to the extruder. More in particular it is advantageous to introduce these liquid hydrocarbons, e.g. mixed with the coal to be processed, at the beginning of the extruder.

Further the invention relates to a device for carrying out the method according to the invention, which device comprises an extruder provided with heating means for adjusting and maintaining a desired temperature profile over the whole length of the extruder and at least one opening provided with means for injecting substances under pressure into the extruder, which device is according to the invention characterized by the fact that at least one opening provided with means for injecting substances under pressure into the extruder is situated at a distance of at least three times the inner diameter of the extruder in front of the end of the screw.

The adjustment of zones within the extruder, in each of which the pressure and the temperature differ from those in the adjacent zone(s) can also be realized by using an extrusion screw the pitch and/or the core diameter of which vary along the length of the extruder.

Behind the extruder there is mounted a device known per se for receiving the reaction product leaving the extruder and for separating from the reaction product at least the greater part of the hydrocarbons which are fluid under normal conditions.

According to a preferred embodiment of the device according to the invention transport means are present for partially recycling the separated hydrocarbons to one or more spots in the extruder.

The invention enables not only the preparation of hydrocarbon products which are fluid under normal conditions in a continuous process, but also the execution of the reaction in a number of zones which are—as seen in the direction of the travel of the reaction product—situated one behind the other, in each zone the pressure, the temperature and the composition of the reaction mixture and the residence time being controllable as required. More in particular the invention enables carrying out the preparation at temperatures and pressures which are higher than the ones normally used up to now, which results in a substantial shortening of the reaction time, e.g., from one hour down to about fifteen minutes.

Figure 2:
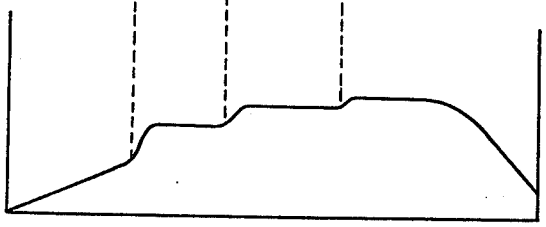

The invention will now be explained with reference to the drawing, in which:

FIG. 1 shows diagrammatically a device according to the invention for the preparation of a fluid hydrocarbon product from coal, and FIG. 2 is a diagram showing the pressure profile in the device of FIG. 1.

Referring to FIG. 1 the device shown mainly comprises an extruder 1 with a screw 2 driven by a drive 3. 4 is a device for feeding the coal to be processed into the extruder, preferably as a powder or as particles and possibly mixed with one or more catalyst.

The coal fed into the extruder 1 by the device 4 is transported to the right by the screw 2. During this transport in the extruder 1 a reaction takes place with hydrogen and/or hydrogen containing compounds which are fed into the extruder 1 via pipes 7, 8, and 9 and by means of pumps 10, 11 and 12 respectively. Through one or more of these pipes catalyst can be added to the reaction mixture in the extruder 1. The temperature of the reaction mixture in the extruder 1 can be controlled by means of heating elements 6 mounted on the outside of the extruder 1, and further by means of heating means (not shown) mounted in the interior of the hollow screw 2.

The reaction mixture leaves the extruder 1 through outlet opening 5 and then reaches a separation device 13 in which by a method known per se at least the greater part of the hydrocyarbon product which is fluid under normal conditions is separated from the reaction mixture and is transported via pipe 14. At the end of pipe 15 this fluid hydrocarbon product is drawn off as final product. However, part of the fluid hydrocarbon product flowing through the pipe 14 can be recycled via pipe 16 and by means of pump 17 to one or more spots in the extruder. More in particular it is advantageous to recycle at least part of the fluid hydrocarbon product direct through the pipe 16, or mixed with the coal from the device 4 to the inlet of the extruder. This recycled hydrocarbon product acts as a lubricant in the section of the extruder where the coal is not yet plastic and there the friction force is thus very high. The presence of a fluid hydrocarbon product can prevent the occurrence of excessive friction forces and consequently an overload of the screw of the extruder.

FIG. 2 shows diagrammatically the pressure profile over the total length of the extruder of FIG. 1. A number of zones located one behind the other can be distinguished and—seen in the direction of the travel of the reaction product—in each next zone the pressure (and also the temperature) is higher than in the preceding zone. This stepwise increase of the pressure can among others be effected by injecting under high pressure hydrogen and/or hydrogen containing compounds through the pipes 7, 8 and 9, but also, by a more or less stepwise change of the pitch and/or the core diameter of the extrusion screw. These and also the length of each zone and the velocity of rotation of the screw determine the period of time during which the reaction mixture resides in each zone.

EXAMPLE I

The method according to the invention was carried out in an extruder divided into two zones. Dry coal from Poland, as used in power stations, was mixed with 5% wt of mineral oil and injected into the extruder. Further hydrogen was injected at the beginning of each zone. The maximum pressure reached in the extruder amounted to 230 bar and the maximum temperature to 450° C.

The conversion of the coal yielded 25% wt gaseous product, 27% wt liquid product (after subtraction of the amount of oil injected together with the coal) and 48% wt solid residue consisting of about 15% wt ash and 33% wt carbon.

EXAMPLE II

Wet coal with 7.5 wt % moisture and 2 wt % ash from this coal as a catalyst was injected into the extruder of example I. No mineral oil was added. The maximum pressure and temperature and the type of the coal were the same as in example I. The conversion of the coal yielded 25% wt gaseous product, 29% wt oil and 46% wt solid residue consisting of 19% wt ash and 27% wt carbon.

It will be clear to a man skilled in the art the optimum temperatures, pressures and residence times should mainly be determined by experiments and strongly depend on the nature of the coal to be processed and the catalyst and the hydrogen containing compounds and further on the desired quality and yield of the fluid hydrocarbon product to be prepared.

I claim:

1. In a method of preparing a hydrocarbon product which is fluid under normal conditions by continuously feeding coal into a screw extruder having a front end and reacting the coal therein at elevated pressure and temperature, optionally in the presence of a catalyst, with hydrogen and/or hydrogen-containing compounds, followed by a step of separating at least the greater part of the hydrocarbons which are fluid under normal conditions from the reaction product leaving the extruder, the improvement comprising adding the catalyst and/or hydrogen and/or hydrogen-containing compounds to the contents of the extruder on at least one spot situated at a distance of at least three times the inner diameter of the extruder upstream of the front end of the screw.

2. A method according to claim 1, wherein the catalyst and/or hydrogen and/or hydrogen-containing compounds are added to the contents of the extruder on at least two spots spaced apart in the direction of the length of the extruder.

3. A method according to claim 1, wherein the reaction takes place in at least two zones, one located behind the other in the direction of the length of the extruder, and wherein the pressure and the temperature in each zone differ from those in the adjacent zone, and wherein the catalyst and/or hydrogen and/or hydrogen-containing compounds are added to the contents of the extruder at least at the beginning of each zone, seen in the direction of travel of the reaction mixture.

4. A method according to claim 3, wherein the reaction takes place in two zones, seen in the direction of travel of the reaction mixture, the first zone having a temperature of 275°-325° C. and a pressure of 75-125 bar, and the second zone having a temperature of 450°-500° C. and a pressure of 250-350 bar and wherein hydrogen is added to the reaction mixture at the beginning of each zone.

5. A method according to claim 1, wherein the extruder is fed with a mixture of coal and catalyst.

6. A method according to claim 1, wherein part of the prepared hydrocarbons which are liquid under normal conditions is recycled to the contents of the extruder.

7. An apparatus for preparing a fluid hydrocarbon product from coal, comprising a screw extruder having a front end provided with heating means for adjusting and maintaining a desired temperature and pressure profile over the length of the extruder, at least one opening provided in the extruder, and means for injecting substances into the extruder under pressure through the opening, the means for injecting substance under pressure into the extruder being located on the extruder at a distance of at least three times the inner diameter of the extruder upstream from the front end of the screw thereof.

8. An apparatus according to claim 7, wherein the extruder has at least two openings therein, each provided with means for injecting substances under pressure into the extruder, which openings are spaced apart in the direction of the length of the extruder.

9. An apparatus according to claim 7, wherein the pitch and/or the core diameter of the screw of the extruder varies over the length of the extruder to increase pressure on the contents during operation thereof.

10. An apparatus according to claim 7, additionally comprising means located downstream of the extruder for receiving the reaction mixture leaving the extruder and means for separating from this reaction mixture at least the greater part of the hydrocarbons which are liquid under normal conditions.

11. An apparatus according to claim 10, additionally comprising transport means for recycling part of the separated liquid hydrocarbons to one or more spots in the extruder.

* * * * *